United States Patent [19]

Klein

[11] 4,442,373

[45] Apr. 10, 1984

[54] APPARATUS FOR REDUCING AERODYNAMIC DRAG IN SYSTEM FOR AIR COOLING A HIGH POWER VACUUM TUBE

[75] Inventor: Robert E. Klein, Quincy, Ill.

[73] Assignee: Harris Corporation, Melbourne, Fla.

[21] Appl. No.: 298,737

[22] Filed: Sep. 2, 1981

Related U.S. Application Data

[63] Continuation of Ser. No. 22,945, Mar. 22, 1979, abandoned.

[51] Int. Cl.[3] ..... H01J 7/26; H01J 61/52

[52] U.S. Cl. ..... 313/35; 313/36; 313/22; 313/24; 313/45; 313/46

[58] Field of Search ..... 313/22, 24, 35, 36, 313/45, 46

[56] References Cited

U.S. PATENT DOCUMENTS

| | | | |
|---|---|---|---|
| 2,324,034 | 7/1943 | Skene | 313/36 X |
| 2,476,647 | 7/1949 | Weschler et al. | 313/24 |
| 2,829,290 | 1/1958 | Van Warmerdam | 313/35 X |
| 3,343,019 | 9/1967 | Wolf et al. | 313/36 X |
| 4,180,763 | 12/1979 | Anderson | 313/17 X |

OTHER PUBLICATIONS

Mair, W. H., "The Effect of a Rear Mounted Disc on the Drag of a Blunt-Based Body of Revolution," The Aeronautical Quarterly, 11/65, pp. 350–360.

Little, Jr., B. H. et al., "Locked Vortex Afterbodies", American Inst. of Aeronautics and Astronautics, Inc., 1978, pp. 296–302.

*Primary Examiner*—Eugene R. LaRoche
*Assistant Examiner*—Vincent DeLuca
*Attorney, Agent, or Firm*—Yount & Tarolli

[57] ABSTRACT

A high power vacuum tube 10 has a cylindrical body 16 and a plurality of radially extending fins 18. A cylindrical wall 20 is co-axially disposed about the body and the fins, thus defining an air channel between the body and the wall. To cool the tube, air is forced into the channel from an entry port, and leaves the channel through an exit port. The cooling capacity of the system is optimized by contouring the entry and exit ports to minimize aerodynamic drag. In one embodiment, the entry into the channel is flared outward and a cone assembly 42 is provided adjacent the longitudinal end of the body 16 nearest the exit port. This cone assembly thus forms a continuation of the body 16 which tapers to a smaller cross section in the direction of air flow. The cone assembly may be formed of a stack of discs 70 of successively smaller diameter. The exit port, which may have either rigid or flexible sidewalls, has a venturi shape to further reduce drag.

13 Claims, 6 Drawing Figures

APPARATUS FOR REDUCING AERODYNAMIC DRAG IN SYSTEM FOR AIR COOLING A HIGH POWER VACUUM TUBE

This is a continuation, of application Ser. No. 022,945 filed Mar. 22, 1979, now abandoned.

BACKGROUND AND FIELD OF THE INVENTION

The present invention relates generally to the art of air cooling of high power vacuum tubes, and more particularly to a system for reducing aerodynamic drag in the path of air flow through the system so as to increase the cooling capacity of the system.

High power broadcasting stations, such as AM, FM, and TV broadcasting stations, conventionally employ large, high power vacuum tubes in the output stage of the transmitter for amplifying the modulated RF signal which is to be transmitted. These vacuum tubes conventionally operate at an extremely high power levels, measured in tens of kilowatts. Since the tubes are, of course, not 100% efficient, a portion of this high power is converted into heat in the tube. Some means must therefore be provided to dissipate this unwanted heat.

These high power vacuum tubes generally have a cylindrical body configuration, with a large number of heat radiating fins extending radially outward from the body. These fins, which all have approximately the same length, are joined at their outer extremities by a wall, which thus has a generally cylindrical configuration and is coaxially disposed about the axis of the vacuum tube body. An air channel is thereby defined between the body of the vacuum tube and the cylindrical wall joining the extremities of the heat radiating fins.

High power vacuum tubes of this type are generally air cooled by forcing large volumes of air through this air channel. The size of the fan used to generate this air flow must, of course, be selected in accordance with the cooling requirements of the vacuum tube being used. For those transmitters using very high power output stages, cooling fans having a very high capacity must be employed. Effective cooling of the tube is critical, since the useful life of the tube is adversely affected by operation at elevated temperatures. It would therefore be desireable to provide greater cooling of the tube so that it operates at a lower temperature and thus has a longer useful life.

SUMMARY OF THE INVENTION

It has been found that this goal may be achieved, without increasing the size of the fan employed, by reducing aerodynamic drag in the path over which the air must flow.

It is therefore an object of the present invention to provide a system wherein aerodynamic drag in the air cooling path is reduced.

It is an additional object of the present invention to modify the contour of the entry port of the air channel used for cooling the tube so as to reduce the aerodynamic drag thereof.

It is yet another object of the present invention to modify the contour of the exit port of the vacuum tube air channel so as to reduce the aerodynamic drag thereof, as well.

It is still another object of the present invention to provide an exit port having flexible walls so that the air pressure within the exit port automatically draws the exit port into the desired low drag configuration.

By modifying the contour of the entry and exit ports of the air flow system, it has been found that aerodynamic drag can be reduced by as much as 60%. This leads to a commensurate increase in cooling capacity, permitting the tube to operate at cooler temperatures than would otherwise have been the case.

BRIEF DESCRIPTION OF THE DRAWINGS

The foregoing and other objects and advantages of the present invention will become more readily apparent from the following detailed description, as taken in conjunction with the accompanying drawings, wherein.

DETAILED DESCRIPTION

Figure 1:
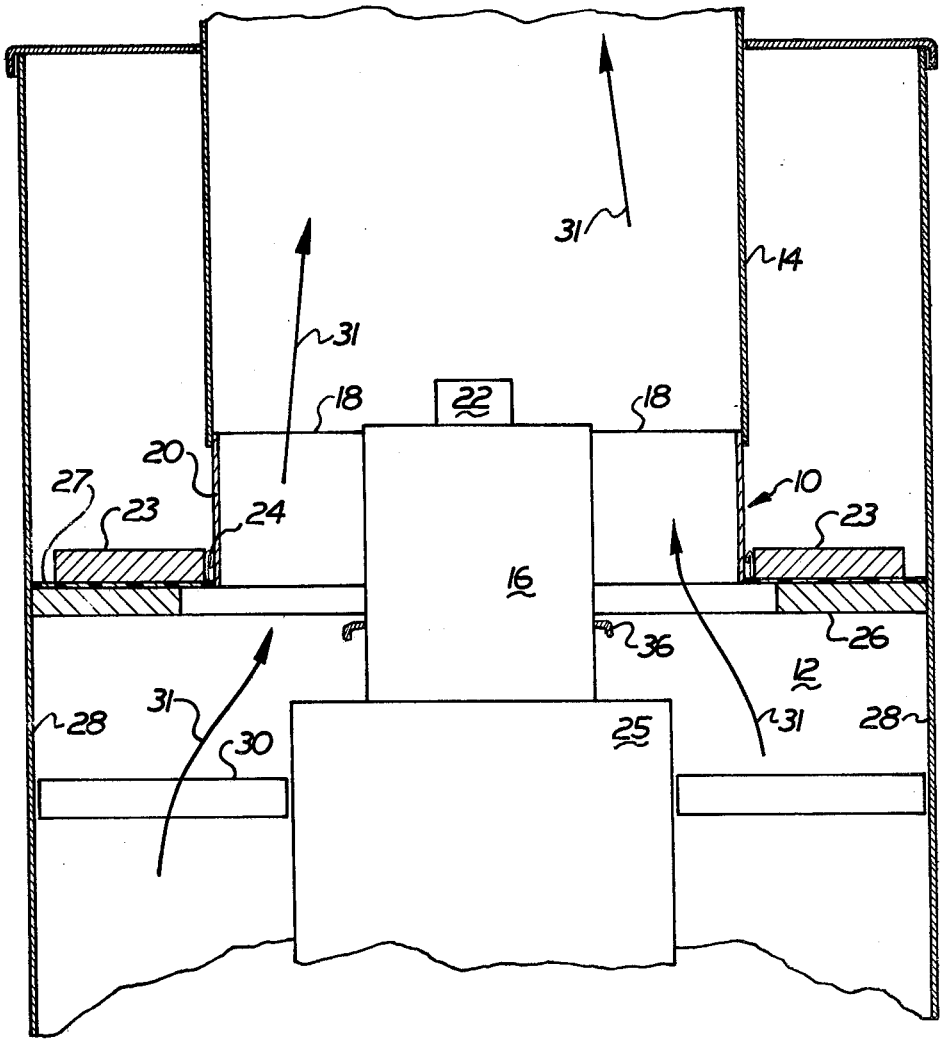
FIG. 1 (PRIOR ART)
FIG. 1 is a sectional elevation view of the path of cooling air flow past a high power vacuum tube, in accordance with the prior art.

There is illustrated in FIG. 1 a sectional view of a conventional high power radio transmitter output stage. In this figure, a high power vacuum tube 10 is mounted at its lower end within an RF resonent cavity 12, and at its upper end to a cylindrical chimney 14.

The high power vacuum tube 10 consists essentially of a generally cylindrical body 16 having a plurality of substantially rectangular heat radiating fins 18 extending radially therefrom. As can best be seen in FIG. 2, which is a plan view of the high power vacuum tube 10, by itself, these heat radiating fins extend from the inner body 10 outward to a wall 20 having a generally cylindrical configuration, and coaxially disposed about the cylindrical body of the vacuum tube 10. An air flow channel is thus defined between the body of vacuum tube 10 and the wall 20. The air may therefore pass in a generally longitudinal direction past the body 16 and the fins 18 to dissipate the heat developed by the tube.

Figure 2:
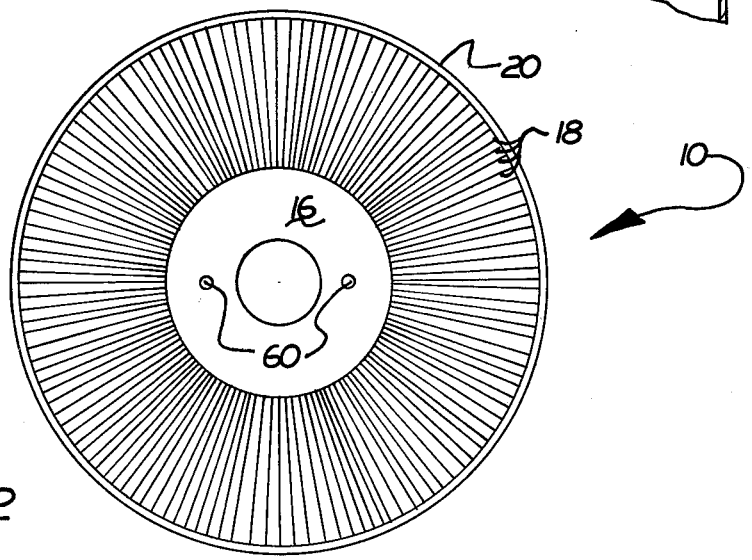
FIG. 2 is a plan view of a conventional high power vacuum tube.

The vacuum tube 10 illustrated generally in FIGS. 1 and 2 includes a number of electrical contacts protruding from the portions of the body 16 above and below the heat radiating fins 18. More particularly, a protrusion 22 extends from the upper portion of the vacuum tube body 16, and provides one means for establishing electrical contact with the anode of the high power vacuum tube 10. The radiating fins 18 are also electrically connected to the anode structure; electrical contact to the anode may therefore be established by simply clamping an electrical lead to the wall 20 joining the outer perimeter of the fins 18. In FIG. 1, an annular metal ring 23 is provided for this purpose, and has a plurality of spring finger contacts 24 attached to the interior of the circular opening therein. These spring finger contacts resiliently engage the wall 20, establishing electrical continuity between the anode of the tube and the annular ring. An insulating sheet 27 of mylar isolates the annular ring from the top of the cavity, which will be grounded.

The electrical connections to the cathode, screen, grid, etc. of the tube 10 are not illustrated in the various figures, since they form no part of the present invention. Conventionally, the box 25 upon which the vacuum tube 10 rests will be connected to the screen of the tube, with the remaining electrical connections being made within this box.

In FIG. 1, the resonent cavity 12 within which the tube 10 is mounted is composed of a cover 26, sidewalls 28, and a floor 30, all constructed of electrically conductive material. The floor 30 of the cavity has a honeycomb construction to permit air to pass through it substantially without restriction. The floor 30 will normally be connected to a gear drive operable to move the floor 30 up and down along the screen box 24 to permit tuning of the cavity 12. Air will be forced into the resonent cavity 12 by means of a conventional fan (not shown), and then will flow past the heat radiating fins 18, and out through the chimney 14 (as indicated by the arrows 31).

In a system of this type, cooling of the high power vacuum tube 10 is dependent upon the flow of air past the heat radiating fins 18. A very high rate of flow past these radiating fins is required for those systems operating at high power levels. Unfortunately, the very high aerodynamic drag normally associated with the air path shown in FIG. 1 significantly restricts this air flow, hampering effective cooling of the high power vacuum. This has been found to be primarily the result of three factors: entry losses associated with the entry of the air flow into the cooling fins from the resonent cavity; shear losses within the heat radiating fin structure itself; and exit losses associated with the exit of the air from the fin structure into the chimney. Although the shear losses are fixed by the structure of the tube and cannot be varied without altering the mechanical design of the fin structure, the entry and exit losses can be substantially reduced by modifying the contour of the entry and exit ports of the fin structure. This can lead to as much as a 40%–60% reduction in the aerodynamic drag within the system, thus producing a commensurate increase in the cooling capacity of the system.

Figure 3:
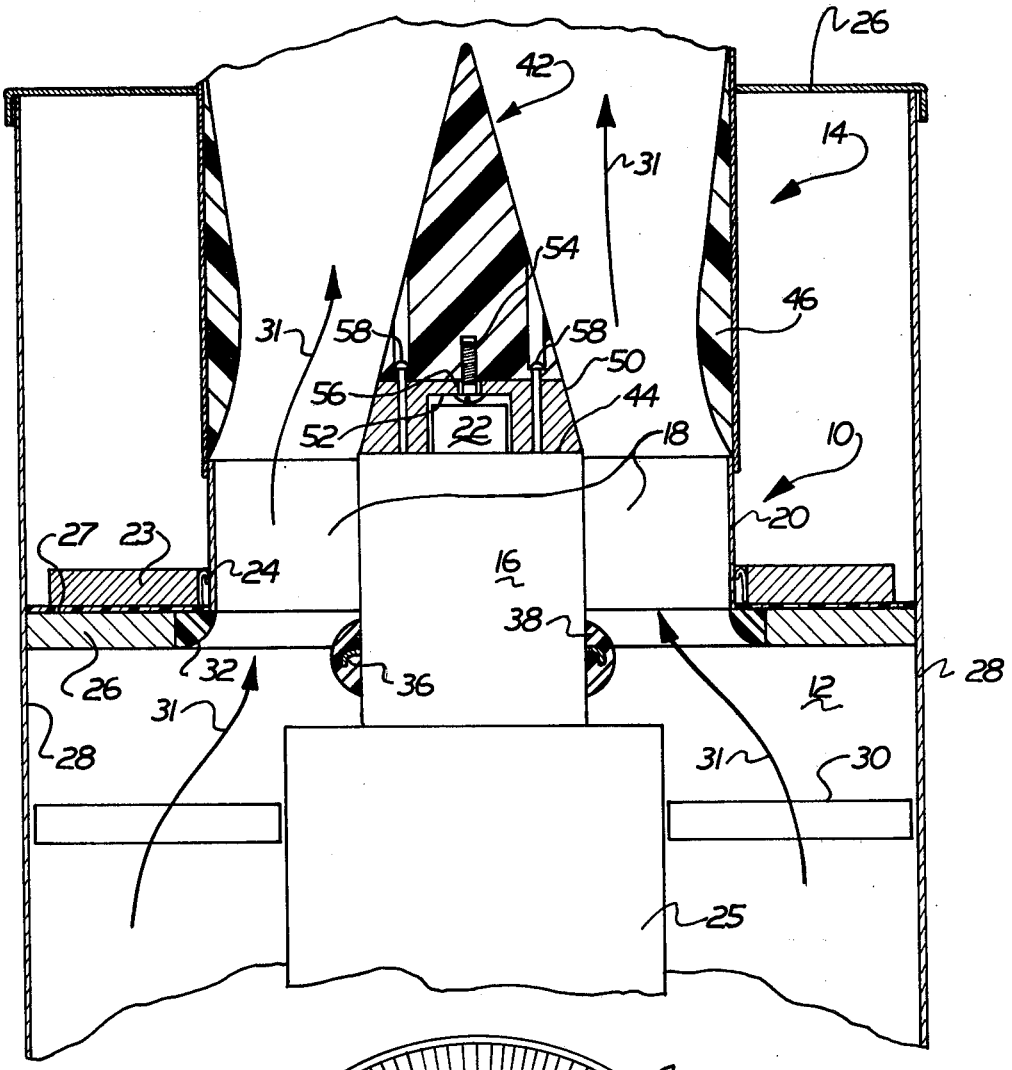
FIG. 3 is a sectional elevation view of the air flow path of FIG. 1, modified in accordance with the teachings of the present invention.

FIG. 3 illustrates the system of FIG. 1, modified in accordance with the present invention. To simplify the description which follows, corresponding parts of the various figures are identified by corresponding reference numerals.

In order to reduce entry losses, the embodiment illustrated in FIG. 3 has been modified so that the entry port to the air cooling channel is flared outward. This is accomplished by means of a quarter-round annular ring 32 having an outside diameter which closely matches the interior diameter of the circular opening in the cover plate 26 through which the tube 10 extends. The quarter-round ring, which may be formed of Teflon or any other convenient insulating material, nests within this circular opening in the cover 26, and may be fastened therein in any convenient manner. The quarter-round surface of the ring 32 faces the interior of the ring, and provides an aerodynamically smooth transition between the cavity 12 and the air cooling channel of the tube.

In some high power vacuum tubes, such as the one illustrated in the figures, an additional anode connection 36 is provided circumferentially projecting from the body 16 of the vacuum tube 10, somewhat below the heat radiating fins 18. This anode connection 36 has been troublesome in the past due not only to the turbulence in the entry flow introduced by it, but also due to the tendency of dirt to collect in the dead air space immediately above the connection. The collection of dust at this point led to the creation of "hot spots" in that vicinity, and hence to premature failure of the tube.

To eliminate both of these difficulties, it is contemplated that this anode connection 36 will be covered with a contoured molding 38. This molding 38, which again may be constructed of any conventional heat resistent insulating material, will preferably be split at two points along its circumference so as to present two half rings which can be easily snapped into place over the anode connection 36. The actual contour of the molding is not critical; the half-round cross sectional shape illustrated has been found to function satisfactorily.

The inclusion of these two components, the quarter-round ring 32 and the contoured molding 38, lead to a reduction in the aerodynamic drag associated with the entry into the heat radiating fins down to a small percentage of its former value.

The exit losses associated with the system are substantially reduced by connecting a cone assembly 42 to the top surface 44 of the body portion 16 of the vacuum tube 10, and by providing an interior annular side molding 46 for modifying the interior contour of the chimney 14 in the vicinity of the exit from the air channel in which the heat radiating fins 18 are located.

Although the cone assembly 42 may be entirely formed of a single material, in FIG. 3 it is illustrated as being comprised of a top portion 48 constructed of an insulating material such as Teflon, and a bottom portion 50 constructed of a highly heat conductive material, such as aluminum. The purpose of providing this heat conductive portion 50 immediately adjacent to top surface 44 of the vacuum tube 10 is to increase the effective cooling area of the tube by conducting heat from the top 44 of the vacuum tube 10 through the aluminum portion 50 to the path of air flow. Bottom portion 50 has an opening 52 therein for receiving the anode connector 22 which protrudes from the top surface 44 of the vacuum tube 10.

In FIG. 3, the top and bottom portions 48 and 50 of the cone assembly 42 are fastened to one another by means of a machine screw 54 which is threadedly received by the top portion 48 through an opening 56 in the bottom portion 50. The cone assembly 42 is then attached to the top surface 44 by means of two machine screws 58 which pass through counter sunk openings in the cone 42, and are received by tapped openings 60 in the top surface of the vacuum tube 10.

For convenience of illustration, the cone assembly 42 is shown in FIG. 3 as having a height equal to approximately twice its diameter. In actual use, however, it is presently preferred that the cone have a much greater height, for example, equal to five times its diameter.

The interior annular side molding 46 is provided to modify the interior contour of the chimney 14 into a venturi shape, further reducing drag at the exit from the heat radiating fins 18. This interior annular side molding will have generally the same contour as illustrated in FIG. 1, however its optimum contour will be determined by the particular system in which it is employed, since it is affected not only by the particular tube 10 employed, but also by the air path treatment at the entry to the heat radiating fins 18. Again, this interior annular side molding may be fabricated of Teflon, or of any other metallic or nonmetallic material.

Figure 4:
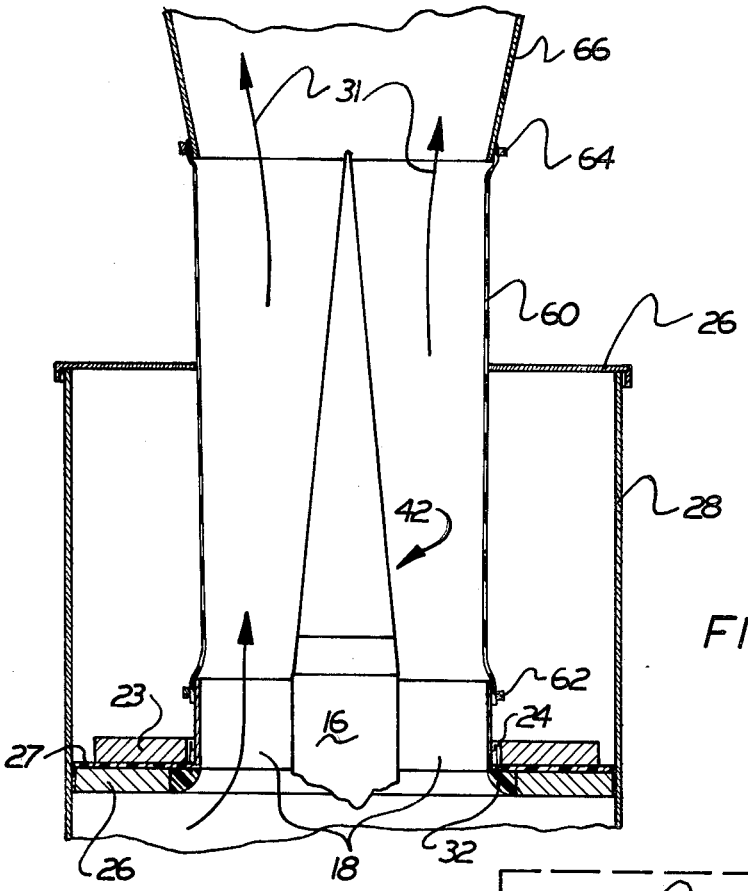
FIG. 4 is an elevation view, partly in section, of an alternative configuration of an exit port in accordance with the present invention.

Referring now to FIG. 4, a second method of imparting the desired venturi shape to the chimney 14 is illustrated. In this embodiment, the rigid sidewalls of the chimney 14 are replaced by a resilient cylindrical sidewall 60 (formed, e.g., of plasticized canvas, silicon rubber, etc.) connected at its lower end to the vacuum tube 10 by means of a clamp 62, and at its upper end to a rigid diffuser 66 by means of a second clamp 64. Although, when relaxed, this flexible sidewall 60 will have a fixed diameter at all places therealong, when the system is in operation the air pressures acting upon its interior and exterior surfaces will deform it into the desired venturi shape. Thus, when air is being forced through the heat radiating fins 18, the air pressure at the exit port of the air channel housing the heat radiating fins 18 will be somewhat reduced from the air pressure in the outside environment. The flexible sidewall 60 will thus be drawn inward at this point, automatically providing the desired exit contour. This embodiment is advantageous not only in that the flexible sidewall 60 will automatically be drawn into the desired venturi shape, but also because this venturi shape has a smooth, unbroken contour cover the entire length of the chimney 14; this would be difficult to achieve in a rigid embodiment.

As is illustrated in this figure, it is further preferred that the chimney 14 include a diffuser 66 so as to reduce the velocity of the air flow at the exit from the chimney, thereby further reducing exit losses through a mechanism known in the art as regain. This figure also illustrates the preferred height of the cone assembly 42.

Figure 5:
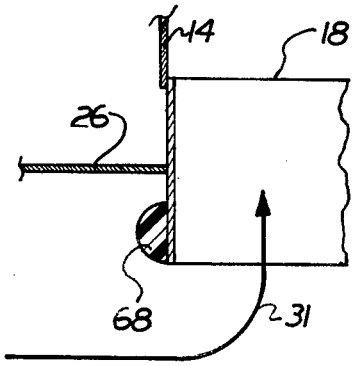
FIG. 5 is a sectional elevation view of another embodiment of an entry port in accordance with the present invention.

Referring now to FIG. 5, an additional manner of modifying the contour at the entry to the heat radiating fins 18 is shown. This embodiment may be preferred in those instances in which little additional space is available immediately below the heat radiating fins, or when the cooling air flow enters the cavity 12 from the side, and must be deflected up into the air channel. In this embodiment, the quarter-round annular ring 32 is replaced by a different circumferential ring 68 having a half-round cross section. This half-round circumferential ring may be held in place in any convenient manner as, for example, by using conventional set screws. It has been found that the inclusion of a contoured ring of this type, although not reducing drag as effectively as the bell shaped opening 32 described previously, nonetheless significantly reduces entry losses, leading to improved cooling performance.

Figure 6:
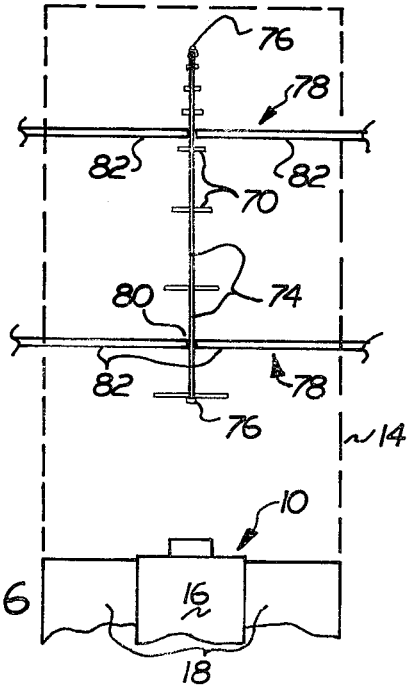
FIG. 6 is an elevation view, partly in section, of another embodiment of the cone assembly used to reduce drag in the exit port.

Referring now to FIG. 6, there is illustrated a second, and presently preferred, embodiment of the cone assembly 42. In this embodiment, the solid cone is replaced by a series of spaced discs 70. A central stem 72 passes through openings in the center of each disc, holding them in the proper axial alignment, while a series of cylindrical spacers 74 carried on the stem establish the appropriate spacing between the discs. The stem, spacer, and disc assembly is held together by means of two nuts 76 which are threaded onto the top and bottom of the stem 72.

The disc spacing must be selected so that the assembly provides the appearance of a solid cone to the air flow. To accomplish this, it is presently preferred that each disc be separated from the next smaller disc by a distance approximately equal to one and one-half times the diameter of that next smaller disc.

In this embodiment, the cone assembly is not mounted directly onto the tube, but is rather held in proper alignment above the tube by two spiders 78. Each spider is clamped at its center 80 to the stem and spacer portion of the cone assembly 42, and includes four arms 82 equally spaced circumferentially about the stem clamp and extending radially therefrom to the side wall 14 of the chimney, indicated in dotted lines in this figure. If a rigid sidewall is used the arms may simply be bolted to the sidewall. If a flexible side wall is used, the arms will extend through slots in the flexible sidewall and be bolted to a frame member (not shown) outside of the chimney. In either case, the cone assembly will be held rigidly in place with respect to the vacuum tube 10.

The arms of the spiders will preferably have a very small cross sectional dimension in the direction perpendicular to the air flow, to reduce aerodynamic drag. Even more preferable, the spiders will have a smooth air foil shape to further reduce air drag.

Although the invention has been described with respect to preferred embodiments, it will be appreciated that the described embodiments are exemplary only, and are in no way intended to limit the scope of the present invention. Thus, the specific contours illustrated and described for the entries and exits to the air channel which houses the heat radiating fin structure may take many forms, with the preferred form in a specific application depending upon the actual cavity, tube and chimney parameters of that system. Also, of course, these streamlining features may be integrated into the design of the tube, itself, or divided between the system and the tube. Consequently, it will be appreciated that various rearrangements and alterations of parts may be made without departing from the spirit and scope of the present invention, as defined in the appended claims.

What is claimed is:

1. Apparatus for use in conjunction with a high power vacuum tube including a body portion having a longitudinal axis, a plurality of heat radiating members each extending transversely outward from said body portion in a direction transverse to said longitudinal axis, channel means for defining a channel through which gas may flow in a longitudinal direction past said body portion and said heat radiating members so as to cool said body portion, and entry and exit ports for directing gas flow into and out of said channel, said apparatus comprising drag reducing means associated with at least one of said entry and exit ports for providing an aerodynamically smooth transition between said channel and said at least one port to minimize gas drag associated with the flow of gas between said port and said channel, thereby improving gas flow through said channel, and improving the dissipation of heat from said high power vacuum tube, wherein said drag reducing means comprising chimney means associated with said exit port from said channel and defining an extension of said gas channel, wherein said chimney means is constructed of a material having sufficient resilience that reduced gas pressure created within the extension air channel by the flow of gas therethrough will draw the chimney means into the desired shape.

2. Apparatus as set forth in claim 1, wherein said chimney means has an opening for exhausting gas therefrom, and where said opening is flared.

3. Apparatus for gas cooling a high power vacuum tube including a body portion generating unwanted heat which must be dissipated by the flow of gas therepast, said apparatus comprising means defining a gas channel having an entrance for admitting gas into said gas channel and an exit for exhausting gas from said gas channel, with at least a portion of the body of said vacuum tube being mounted within said gas channel between said entrance and said exit, wherein a portion of said channel defining means downstream of the position along said channel at which said body of said vacuum tube is mounted has a reduced cross section and aerodynamically smooth transitions to and from said reduced cross section so as to provide a smooth aerodynamic transition between the portion of the channel containing said body of said vacuum tube and the portion downstream thereof, and wherein at least said portion of said gas channel defining means downstream of the position at which said body of said vacuum tube is mounted is formed of resilient material such that gas pressure within said gas channel draws that portion of said gas channel into the desired shape.

4. Apparatus for gas cooling a high power vacuum tube including a body portion generating unwanted heat which must be dissipated by the flow of gas therepast, said apparatus comprising means defining an gas channel having an entrance for admitting gas into said gas channel and an exit for exhausting gas from said gas channel, with at least a portion of the body of said vacuum tube being mounted within said gas channel between said entrance and said exit, and wherein at least a portion of said gas channel defining means is constructed of a resilient material whereby the shape of said gas channel in the vicinity of said at least a portion thereof will be determined by gas pressure within the gas channel at that point.

5. Apparatus as set forth in claim 4, and further comprising means for providing said body portion with a shape which effectively tapers along a line parallel to the direction of gas flow so as to reduce aerodynamic drag associated with the presence of said body portion within said gas channel.

6. Apparatus as set forth in claim 5, wherein at least a portion of said means for providing said body portion with a tapered shape is constructed of a highly heat conductive material so that heat generated in said body portion is conducted to the tapered surface of said means.

7. Apparatus as set forth in claim 5, wherein said means for providing said body portion with a tapered shape comprises a plurality of plates disposed in spaced relation to one another and said body portion along said line parallel to the direction of gas flow with the outer edges of said plates defining said effectively tapered shape.

8. Apparatus as set forth in claim 7, wherein said plates are oriented substantially parallel to one another and perpendicular to said line parallel to the direction of gas flow, said plates being arranged in order of size, and wherein the spacing between each plate and the next is dependent upon the size of that plate.

9. Apparatus for use in conjunction with a high power vacuum tube including a generally cylindrical body, a plurality of heat radiating fins extending radially outward from said body, and a wall extending circumferentially around said fins whereby a channel exists between said body and said walls through which gas may flow to cool said body and fins, said apparatus comprising a chimney adapted to adjoin one end of said channel for receiving gas from said channel, said chimney having a substantially constant cross sectional size and shape matching the cross sectional size and shape of said wall, but having a venturi-like constriction near the axial end adjoining said channel whereby gas flow between said channel and said chimney is improved due to reduced turbulence in said gas flow.

10. Apparatus as set forth in claim 9, and further comprising cone-shaped means disposed at the axial end of said body nearest said chimney for further reducing turbulence in said gas flow by providing said body with a cross sectional diameter which tapers in a regular manner in the direction of gas flow.

11. Apparatus as set forth in claim 10, wherein said cone-shaped means comprises plural spaced apart disks of differing diameters arranged in order of size.

12. Apparatus as set forth in claim 9 and further comprising means for providing said circumferential wall with a flared entrance.

13. Apparatus as set forth in claim 9 and further comprising means for providing said chimney with a flared exit.

* * * * *